US005501047A

United States Patent [19]

Delaunay et al.

[11] Patent Number: 5,501,047

[45] Date of Patent: Mar. 26, 1996

[54] SECUREMENT PROFILE FOR WALL COVERING WITH INVISIBLE MOUNTING

[75] Inventors: Gerard Delaunay, Bargemon; Francois X. Isaia, Olette, both of France

[73] Assignee: Profilfix, Olette, France

[21] Appl. No.: 133,161

[22] PCT Filed: Mar. 30, 1992

[86] PCT No.: PCT/FR92/00284

§ 371 Date: Dec. 15, 1993

§ 102(e) Date: Dec. 15, 1993

[87] PCT Pub. No.: WO92/18722

PCT Pub. Date: Oct. 29, 1992

[30] Foreign Application Priority Data

Apr. 15, 1991 [FR] France ..... 91 04572
Oct. 21, 1991 [FR] France ..... 91 12951

[51] Int. Cl.[6] ..... A47H 23/00

[52] U.S. Cl. ..... 52/273; 52/287.1; 160/327

[58] Field of Search ..... 52/222, 273; 160/327

[56] References Cited

U.S. PATENT DOCUMENTS 4,083,157 4/1978 Anthonioz ..... 52/273 X
4,197,686 4/1980 Baslow ..... 52/273
4,408,433 10/1983 Scherrer ..... 52/222 X
4,625,490 12/1986 Baslow .
4,676,016 6/1987 Phillips et al. .
4,782,883 11/1988 Braiotta ..... 160/327 X
4,817,699 4/1989 Fein ..... 52/222 X
4,887,626 12/1989 Dalo ..... 52/222 X

FOREIGN PATENT DOCUMENTS 2570651 3/1986 France .
WO81/00234 2/1981 WIPO .

*Primary Examiner*—Carl D. Friedman
*Assistant Examiner*—Beth A. Aubrey
*Attorney, Agent, or Firm*—Young & Thompson

[57] ABSTRACT

The present invention is in the field of stretched wall coverings. It permits using this technique without recourse to specific tools even in very narrow portions of the panels to be covered. The device according to the invention is constituted by a thin profile of PVC comprising a flexible strip (5) for gripping cloth, comprised by two spaced lips (5*a*, 5*b*) lying in a same plane which is perpendicular to the surface to which the profile (1) is applied. A tapered edge (3) provides a recess to receive the edge of the cloth and a double-faced adhesive band (13) permits adjusting the cloth before its final mounting and contributes to this mounting. The device according to the invention is particularly adapted for applying wall coverings or the like, with an invisible mounting, for example in very narrow portions of panels.

4 Claims, 3 Drawing Sheets

SECUREMENT PROFILE FOR WALL COVERING WITH INVISIBLE MOUNTING

FIELD OF THE INVENTION

The present invention relates to a device for the securement of wall coverings and the like, with invisible mounting, particularly sheets and cloths, natural or synthetic.

BACKGROUND OF THE INVENTION

In this field, the applicant has proposed in its French patent application No. 9104572, filed Apr. 15, 1991, a specific profile comprising a flexible strip for mounting the cloth, a tapered edge to receive the border of the cloth, a double-faced adhesive strip for straight line adjustment of the cloth and a gripper adapted for clamping the padding by its edge.

But such a profile cannot be used in particular cases such as those relating to corners of doors and windows, the required angles and all the cases in which the narrowness of the panels renders difficult the execution because of too great width of the profile. On the other hand, the shape of the strip proposed in this parallel lipped profile for the tapered edge does not permit in all cases sufficient retention of the cloth between itself and the confronting portion.

SUMMARY OF THE INVENTION

The device according to the present invention particularly overcomes these drawbacks.

According to a first characteristic, the invention has for its object a profile of the type comprising on the one hand a hollowed out edge, for example tapered and on the other hand a flexible strip running parallel to the axis of the profile and prolonging the end edge defined by the acute angle of the bevel or of the recess at the level of the upper surface and in which this flexible strip comprises two spaced lips lying in a same plane perpendicular to the bearing surface for the profile and parallel to the edges of said profile.

According to a preferred embodiment, the two lips of the strip are disposed in diverging relation, with a first lip having a rounded bevelled edge in a direction opposite to the bevelled edge connecting the strip to the surface for bearing and mounting of the profile; the second lip is perpendicular to this edge such that the conjoint effect of the two lips of the strip guarantees a complete securement of the cloth against an adjacent wall or another profile in the case of angled fittings.

According to a first modification adapted for the mounting of sheets and cloths except doubled sheets, padding, linings, etc., this profile is simply constituted of a profile of the lath type of small width called "Jonc", in the term of art, of a width of the order of 15 mm including the width of the strip. This profile whose width is reduced to a fraction relative to a gripping profile, permits covering narrow surfaces, down to 30 mm width, using two profiles whose edges opposite the strip are disposed side by side. In the case of and according to another characteristic, all the upper surface of the profile of small width on which come to rest the stretched cloth, is counterglued with an adhesive double-faced strip. According to another modification in the case in which the profile is adapted to receive a padding or lining by means of a longitudinal recess opening on the upper surface and closed by a gripper extending over all the width: said gripper is provided on the lower portion of its end with a small tongue directed downwardly and inclined in the direction of the base of the gripper to ensure a retention of the padding with a non-return means in the fashion of a harpoon.

BRIEF DESCRIPTION OF THE DRAWINGS

The profile comprising the invention is of a white synthetic material, for example PVC. Its characteristics and advantages will become apparent from the description which follows with reference to the accompanying drawings.

DETAILED DESCRIPTION OF THE INVENTION

Figure 1:
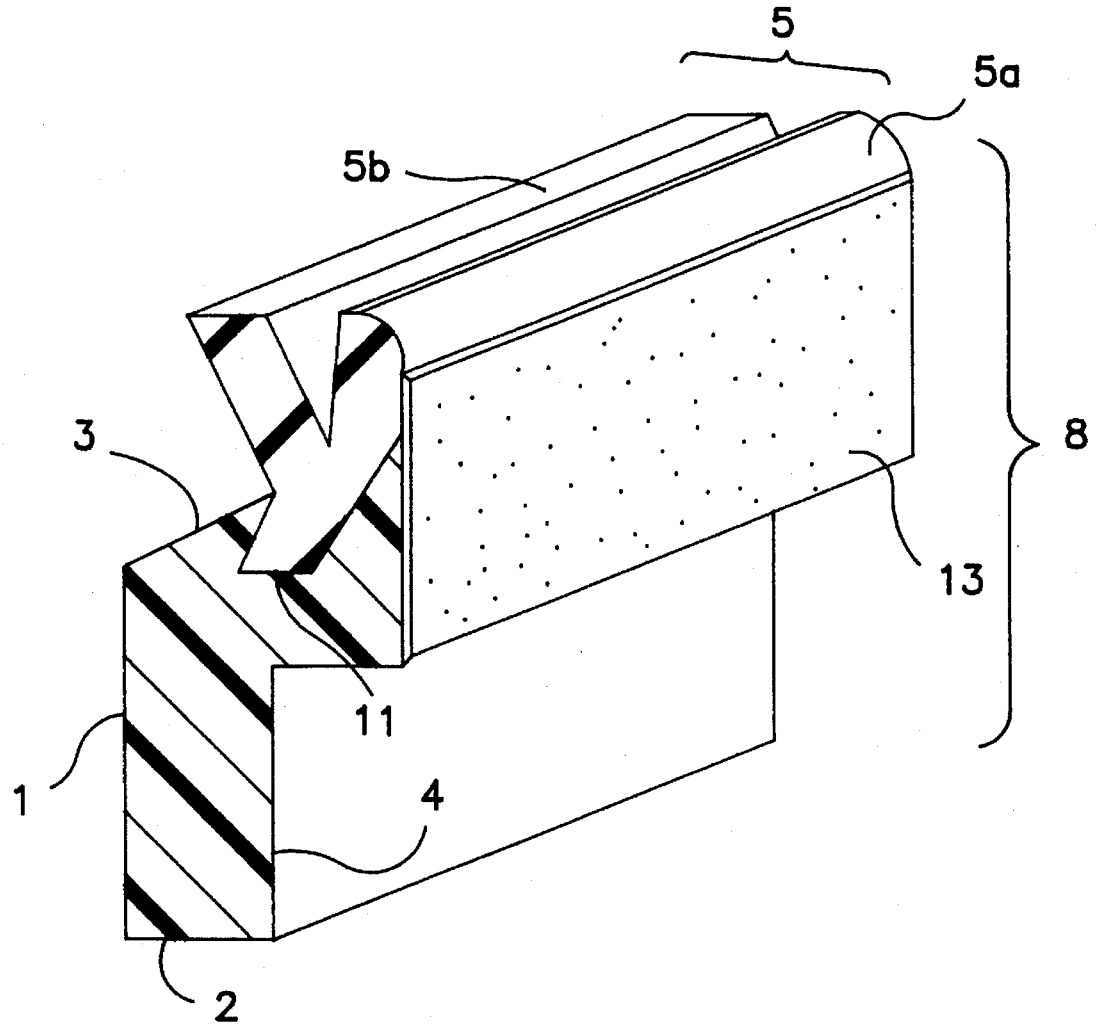
FIG. 1 is a perspective view of the profile forming the device according to the invention.

This device is constituted by a thin white profile. As seen in cross section as illustrated FIG. 1, it is inscribed overall in a contour of a parallelepipedal lath, such that, as shown on its edge on an enlarged scale, it comprises on its back (1) a flat sole by which it is adapted to be applied against a wall to be covered. This rear application surface (1) is prolonged at its lower end by a short ridge (2) defining an edge perpendicular or not. At its opposite end, the rear (1) is prolonged by a tapered edge (3) whose end acute angle defines the upper edge of the opposite surface (4) which it follows. This angle is bordered by a flexible strip (5) for example connected by gluing or fixing in a recess or a groove (11). This longitudinal strip (5) striated or not, has in cross section two lips (**5*a*) (5*b*) that diverge. As a modification, the tapered portion (3) can be replaced by a groove or throat ensuring the same disengagement as the taper to receive the edge of the stripped cloth. The surface (4) is adapted to receive nails or pins if these mounting means are preferred to cementing the back (1). This surface (4) is counterglued with a double-faced adhesive strip (13**) along all its width. This arrangement permits temporary securement of the cloth and contributes to its tensioned mounting.

Figure 2:
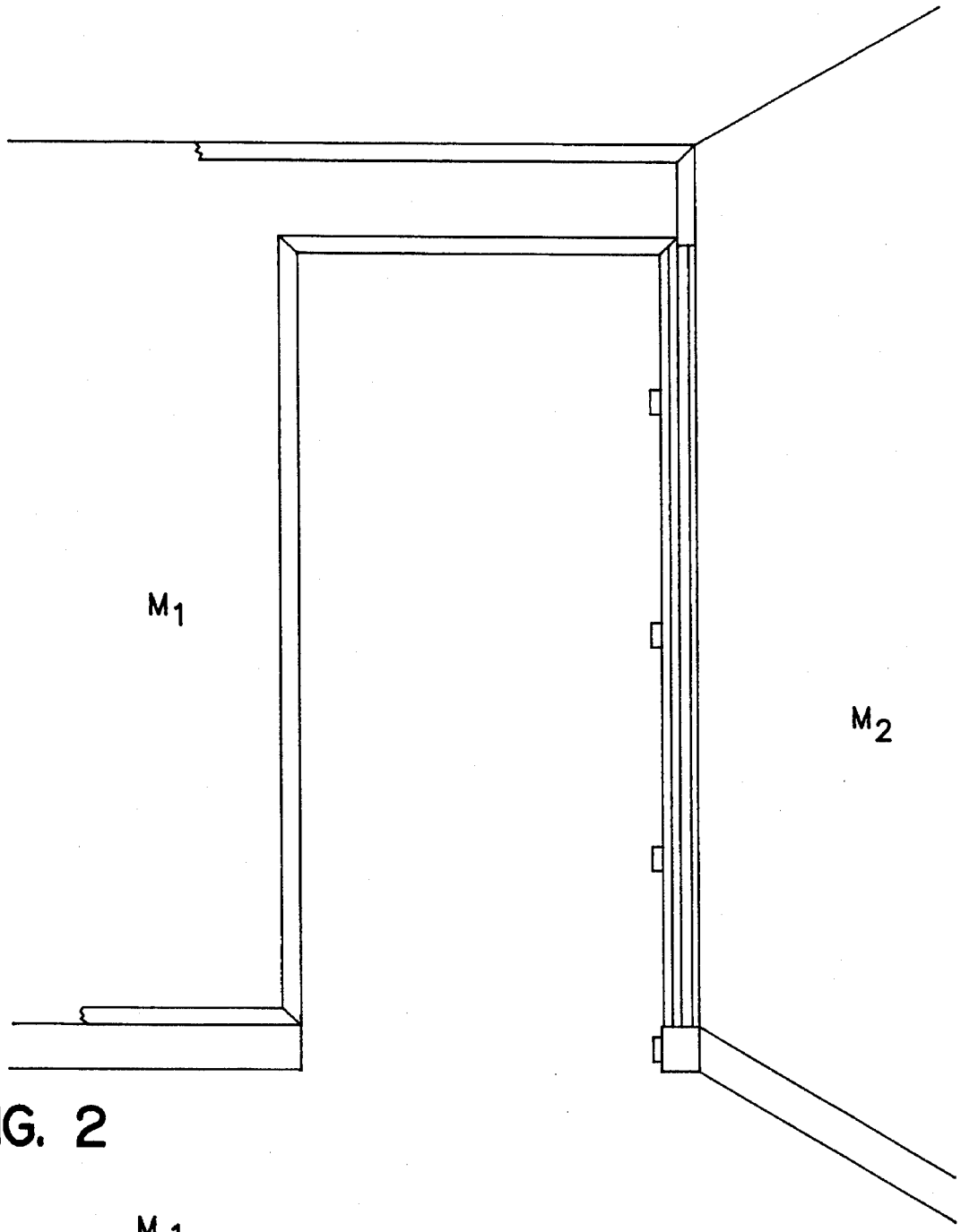
FIG. 2 shows the arrangement of the profiles in a corner of a wall behind a door seen from the front.
Figure 3:
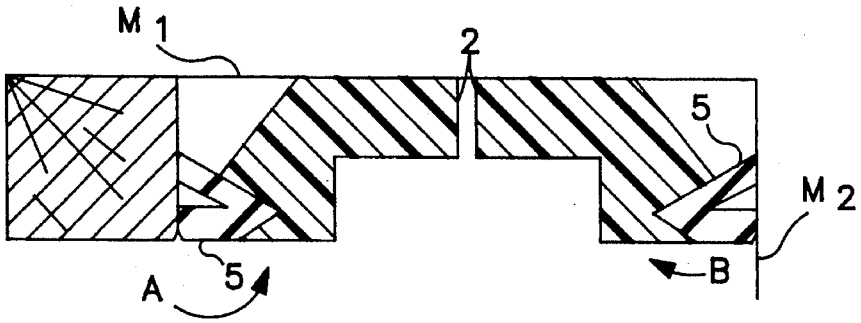
FIG. 3 is an enlarged cross-sectional view of this arrangement.
Figure 4:
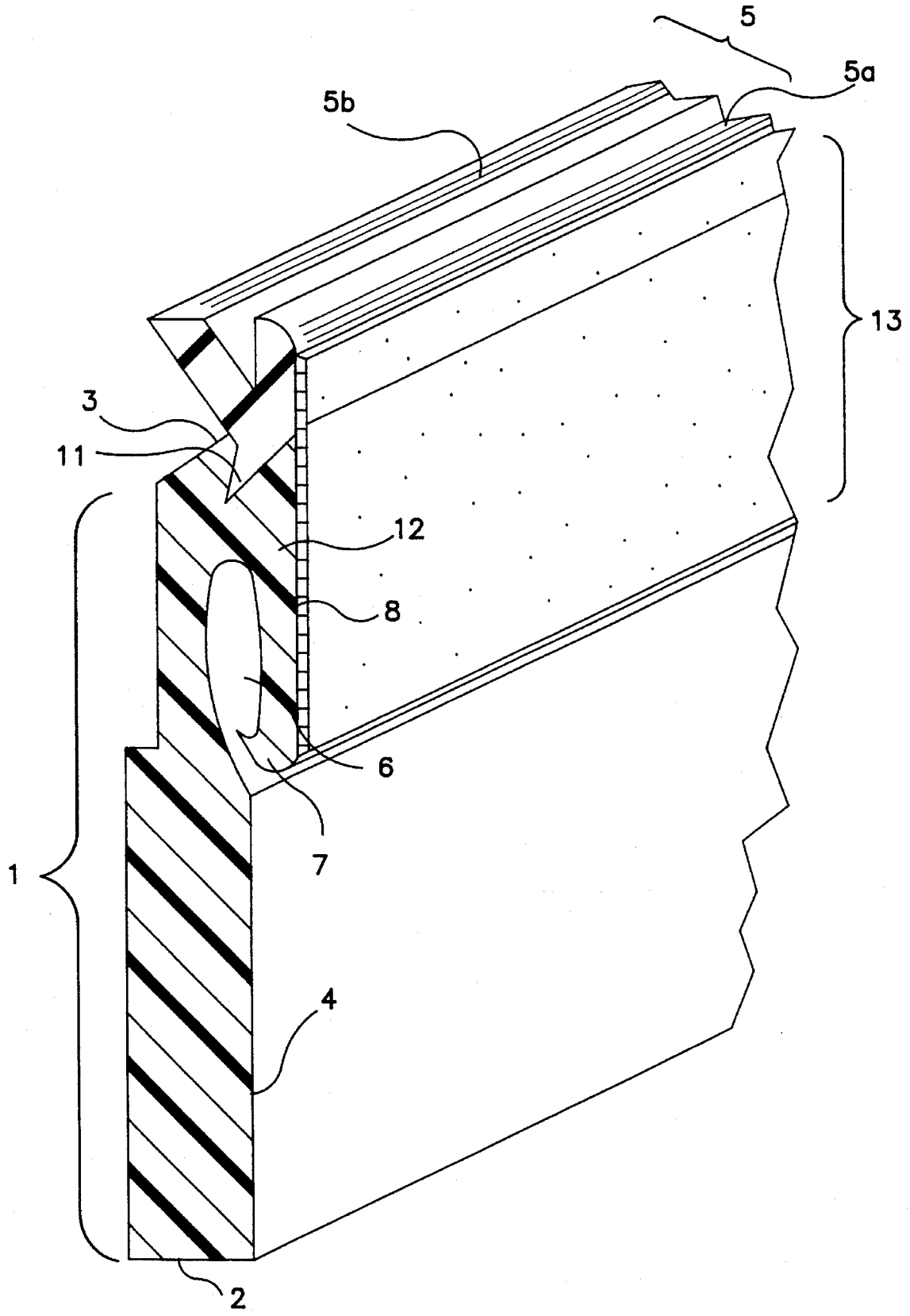
FIG. 4 shows a perspective view of the profile with the gripper.

FIGS. 2 and 3 show a present case of use of the device according to the invention: in FIG. 2 is shown the corner of two walls in one of which is located a door; the narrow strip situated between the corner of the two walls and the door frame is provided with two profiles according to the present invention. On an enlarged scale, the cross-sectional view of these two profiles A, B (FIG. 3) shows opposed edges 2, their respective strips bearing one against the portion of the door frame that projects from the wall (M1), the other against the wall (M2). This arrangement permits mounting the cloth in the narrow corner comprised between the door and the wall (M2). In the case illustrated in FIG. 4 in which the profile is adapted also to receive a lining underlying the sheet, it comprises also a notched gripper adapted to clamp in place the lining by its edge. A rounded and notched lip (7) defines the end of a clamping jaw (12) occupying the forward portion of the upper surface (3) of the profile. This jaw delimits the access to a longitudinal recess (6) adapted to receive the edge of the lining sheet.

The two lips (**5*a*) (5*b*) of the flexible strip are disposed in diverging fashion, with a first upper lip (5*a*) rounded toward the opposite surface of the bearing surface of the profile and prolonging the same plan as the surface (8) and a second lip (5*b*) perpendicular to the edge (3**).

We claim:

1. A device for securement of a wall covering, the device comprising a profile having a rear bearing surface having an upper end terminating in a tapered edge, an opposite surface substantially parallel to the rear bearing surface, said tapered edge including a groove and terminating at an acute angle defining an upper edge of the opposite surface, and a flexible strip mounted within said groove and having two diverging spaced lips extending away from said tapered edge, said two diverging spaced lips having distal ends lying in a plane which is perpendicular to the rear bearing surface of the profile, the tapered edge and flexible strip forming a recess for receiving an edge of the covering.

2. Device according to claim 1, wherein the distal end of a first lip of said two diverging spaced lips of the flexible strip is rounded and extends from said distal end to a plane of the opposite surface, and a second lip of said two diverging spaced lips of the flexible strip is perpendicular to the tapered edge.

3. Device according to claim 1, wherein the profile has an upper flat surface and has but a small width to permit mounting coverings on narrow surfaces, said upper flat surface being counter-glued with a double-faced adhesive strip.

4. Device according to claim 3, further including means for ensuring the retention of a doubled padding, said means comprising a gripper opening on the upper surface of the profile and defining on said upper surface two offset surfaces, said gripper having a bottom end and being provided with a notched lip near said bottom end, for ensuring gripping of the padding in the gripper.

* * * * *